US012085085B2

(12) United States Patent
Tanaka

(10) Patent No.: US 12,085,085 B2
(45) Date of Patent: Sep. 10, 2024

(54) VACUUM PUMP SYSTEM AND CONTROL METHOD

(71) Applicant: SHIMADZU CORPORATION, Kyoto (JP)

(72) Inventor: Shingo Tanaka, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 18/140,929

(22) Filed: Apr. 28, 2023

(65) Prior Publication Data

US 2023/0417254 A1 Dec. 28, 2023

(30) Foreign Application Priority Data

Jun. 24, 2022 (JP) ..... 2022-102207

(51) Int. Cl.
*F04D 27/00* (2006.01)
*F04D 19/04* (2006.01)
*F04D 27/02* (2006.01)

(52) U.S. Cl.
CPC ..... *F04D 27/008* (2013.01); *F04D 27/001* (2013.01); *F04D 27/0292* (2013.01); *F04D 19/042* (2013.01); *F04D 19/048* (2013.01)

(58) Field of Classification Search
CPC .... F04D 27/008; F04D 27/001; F04D 19/042; F04D 19/048; F04D 27/0292
See application file for complete search history.

(56) References Cited

U.S. PATENT DOCUMENTS

2008/0274288 A1* 11/2008 Kondo ..... C23C 16/4408 427/294

FOREIGN PATENT DOCUMENTS

JP 2004-150340 A 5/2004

* cited by examiner

*Primary Examiner* — Sabbir Hasan
*Assistant Examiner* — Andrew J Marien
(74) *Attorney, Agent, or Firm* — Renner, Otto, Boisselle & Sklar, LLP

(57) ABSTRACT

To properly set a predetermined threshold for the number of times of occurrence of an abnormality for issuing an alarm. A vacuum pump system includes a storage, a pump controller, and a setter. The storage stores a first threshold for the number of times of occurrence of the abnormality for outputting the alarm. The pump controller counts the number of times of occurrence of the abnormality caused in a vacuum pump, determines whether or not the number of times of occurrence of the abnormality is the first threshold or more, and outputs the alarm in a case where the number of times of occurrence of the abnormality is the first threshold or more. The setter sets or changes the first threshold on the basis of an operation state of the vacuum pump.

9 Claims, 9 Drawing Sheets

VACUUM PUMP SYSTEM AND CONTROL METHOD

CROSS-REFERENCE TO RELATED APPLICATIONS

This application claims priority under 35 U.S.C. § 119 to Japanese Patent Application No. 2022-102207 filed on Jun. 24, 2022. The entire disclosure of Japanese Patent Application No. 2022-102207 is hereby incorporated herein by reference.

BACKGROUND OF THE INVENTION

1. Technical Field

The present invention relates to a vacuum pump system and a method for controlling a vacuum pump.

2. Background Art

Some vacuum pumps pump gas by rotary drive of rotors by motors. In a vacuum pump described in JP-A-2004-150340, the axial displacement of a rotor shaft is detected, the number of times of detection is accumulated, and a warning is issued in a case where the cumulative number of times exceeds a predetermined number of times or exceeds the predetermined number of times within a predetermined time.

SUMMARY OF THE INVENTION

In a typical vacuum pump such as the vacuum pump described in JP-A-2004-150340, the above-described predetermined number of times (threshold) is a fixed value determined based on, e.g., experience about the cumulative number of times of occurrence of an abnormality leading to a high risk of damage of the vacuum pump.

However, in the case of a vacuum pump with few records on the necessity of issuance of a warning according to the number of times of occurrence of an abnormality, it is difficult to determine a threshold for issuing the warning based on, e.g., experience. Moreover, in a case where the threshold is a fixed value, a vacuum pump of which the number of times of occurrence of the abnormality is less than expected issues no alarm in some cases even when an operation time of the vacuum pump reaches a time at which maintenance for the vacuum pump is required. That is, in a case where the threshold is the fixed value, the warning cannot be issued in a proper timing in some cases.

The present invention has been made to solve the above-described typical problems, and an object of the present invention is to properly set a predetermined threshold according to vacuum pump characteristics in a vacuum pump for which it is determined whether or not the number of times of occurrence of an abnormality has exceeded the predetermined threshold.

A vacuum pump system according to one aspect of the present disclosure is a system including a vacuum pump configured to pump gas by drive of a rotor by a motor. The vacuum pump system includes a storage, a controller, and a setter. The storage stores a first threshold for the number of times of occurrence of an abnormality for outputting an alarm. The controller is configured to count the number of times of occurrence of the abnormality occurred in the vacuum pump, determine whether or not the number of times of occurrence of the abnormality is the first threshold or more, and output the alarm in a case where the number of times of occurrence of the abnormality is the first threshold or more. The setter is configured to set or change the first threshold based on an operation state of the vacuum pump.

In the above-described vacuum pump system configured to output the alarm in a case where the number of times of occurrence of the abnormality is the first threshold or more, the setter sets or changes the first threshold on the basis of an actual operation state of the vacuum pump. Thus, the first threshold suitable for an individual vacuum pump can be set with reference to the actual operation state of the vacuum pump, and therefore, the alarm can be output in a proper timing.

DETAILED DESCRIPTION OF THE EXEMPLARY EMBODIMENTS

Vacuum Pump System

Figure 1:
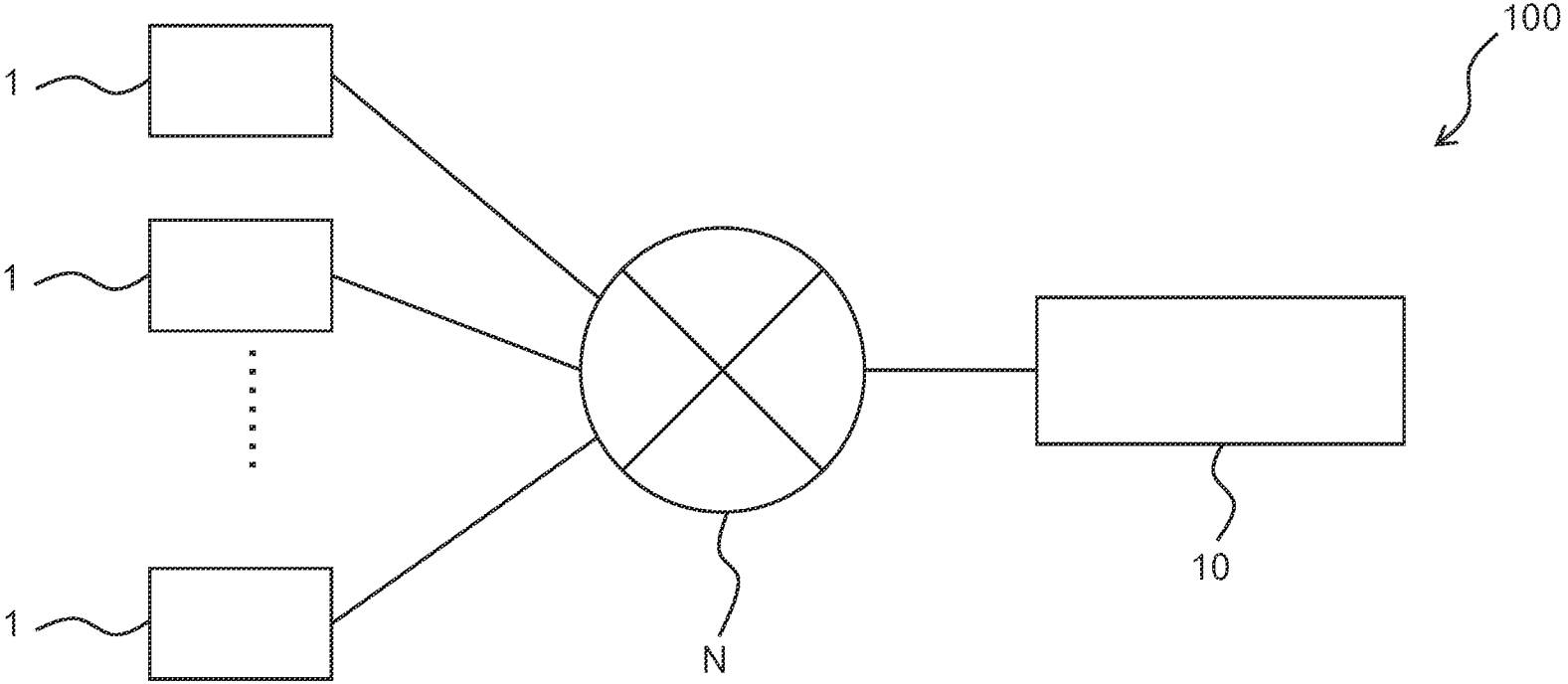
FIG. 1 is a diagram showing the configuration of a vacuum pump system.

A vacuum pump system 100 will be described with reference to FIG. 1. FIG. 1 is a diagram showing the configuration of the vacuum pump system 100. The vacuum pump system 100 is provided, for example, at a semiconductor plant where, e.g., a semiconductor device is manufactured by execution of various processes in a process chamber (not shown). The vacuum pump system 100 includes multiple vacuum pumps 1 and a setting device 10.

The multiple vacuum pumps 1 perform vacuum pumping for a pumping target such as the process chamber. Note that in the vacuum pump system 100, one vacuum pump 1 may perform vacuum pumping for one pumping target or some of the multiple vacuum pumps 1 may perform vacuum pumping for one pumping target. In a case where an abnormality has occurred in the vacuum pump 1, such a vacuum pump outputs an alarm when the number of times of occurrence of the abnormality exceeds a first threshold. The output of the alarm is a general term for, e.g., processing of issuing the alarm, storing the alarm in a storage device, and/or stopping operation of the vacuum pump. Hereinafter, a case where the alarm is issued will be described as an example of the output of the alarm. For example, in a case where the alarm has been issued, a user overhauls, for maintenance, the vacuum pump having issued the alarm so that a component of the vacuum pump can be replaced as necessary.

The setting device 10 is connected to the multiple vacuum pumps 1 via a network N, and makes various settings for the multiple vacuum pumps 1. The setting device 10 refers to various types of information stored in the vacuum pump 1 so that setting operation can be executed with reference to these various types of referred information.

The setting device 10 is a computer system including a CPU, a storage device (RAM, ROM, HDD, SSD, and the like.), and various interfaces such as a communication interface. The setting device 10 is, for example, a personal computer, a tablet terminal, or a mobile terminal. Alternatively, the setting device 10 may be, for example, a server such as a cloud server. The network N is, for example, a network line such as a wireless LAN, a wired LAN, or a WAN or an individual communication line included in the vacuum pump 1.

Here, the "abnormality" occurred in the vacuum pump 1 means that a measurement value of a sensor provided in the vacuum pump 1 deviates from a normal value.

Vacuum Pump

Figure 2:
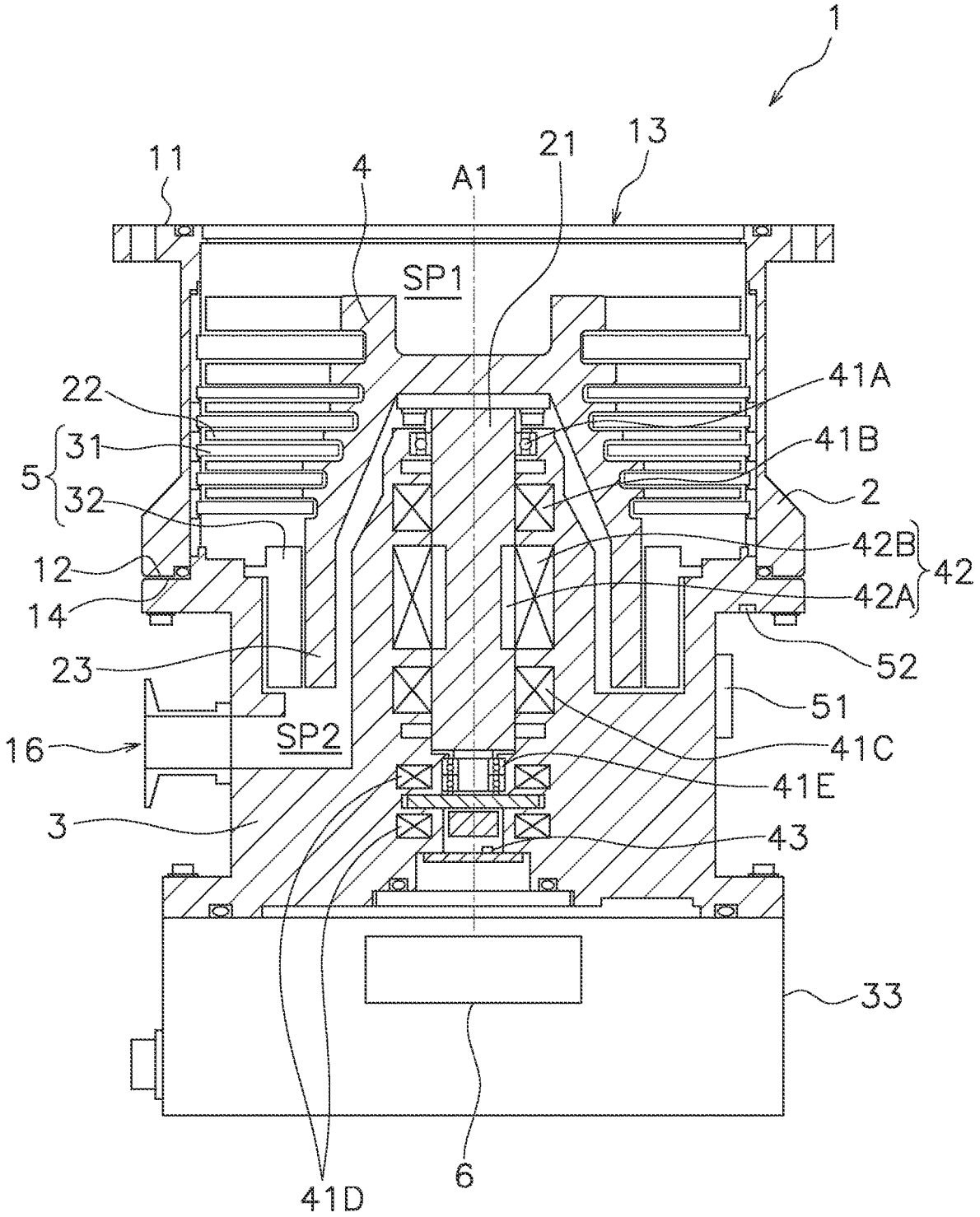
FIG. 2 is a view showing the configuration of a vacuum pump.

The vacuum pump 1 included in the vacuum pump system 100 will be described with reference to FIG. 2. FIG. 2 is a view showing the configuration of the vacuum pump 1. The vacuum pump 1 includes a housing 2, a base 3, a rotor 4, a stator 5, and a pump control device 6.

The housing 2 includes a first end portion 11, a second end portion 12, and a first internal space SP1. A suction port 13 is provided at the first end portion 11. The first end portion 11 is attached to the pumping target (not shown). The first internal space SP1 communicates with the suction port 13. The second end portion 12 is positioned opposite to the first end portion 11 in the direction of extension of the axis A1 of the rotor 4. The second end portion 12 is connected to the base 3. The base 3 includes a base end portion 14. The base end portion 14 is connected to the second end portion 12 of the housing 2.

The rotor 4 is connected to a shaft 21. The shaft 21 extends in the direction of extension of the axis A1. The shaft 21 is rotatably housed in the base 3. The rotor 4 includes multiple stages of rotor blades 22 and a rotor cylindrical portion 23. The multiple stages of the rotor blades 22 are connected to the shaft 21. The multiple rotor blades 22 are arranged at intervals in the direction of extension of the axis A1. Although not shown in the figure, the multiple stages of the rotor blades 22 radially extend about the shaft 21. Note that in the drawing, a reference numeral is assigned only to one of the multiple stages of the rotor blades 22, and reference numerals for the other rotor blades 22 are not shown. The rotor cylindrical portion 23 is arranged below the multiple stages of the rotor blades 22. The rotor cylindrical portion 23 extends in the direction of extension of the axis A1.

The stator 5 includes multiple stages of stator blades 31 and a stator cylindrical portion 32. The multiple stages of the stator blades 31 are connected to an inner surface of the housing 2. The multiple stages of the stator blades 31 are arranged at intervals in the direction of extension of the axis A1. Each stage of the stator blades 31 is arranged between adjacent ones of the multiple stages of the rotor blades 22. Although not shown in the figure, the multiple stages of the stator blades 31 radially extend about the shaft 21. Note that in the drawing, reference numerals are assigned only to two of the multiple stages of the stator blades 31, and reference numerals for the other stator blades 31 are not shown. The stator cylindrical portion 32 is fixed in thermal contact with the base 3. The stator cylindrical portion 32 is arranged so as to face the rotor cylindrical portion 23 with a slight clearance in a radial direction of the rotor cylindrical portion 23. A spiral groove is provided at an inner peripheral surface of the stator cylindrical portion 32.

As shown in FIG. 2, a second internal space SP2 is formed further on a downstream side with respect to exhaust-downstream-side end portions of the rotor cylindrical portion 23 and the stator cylindrical portion 32. Gas is pumped from the pumping target into the second internal space SP2. The second internal space SP2 communicates with an exhaust port 16. The exhaust port 16 is provided at the base 3. Another vacuum pump (not shown) is connected to the exhaust port 16.

The pump control device 6 is housed inside a casing 33 provided below the base 3, and controls the vacuum pump 1. The pump control device 6 issues an alarm or a warning to notify occurrence of the abnormality in the vacuum pump 1 in a case where a levitation position of the shaft 21 measured by later-described displacement sensors 44A to 44C, a value of current supplied to a motor 42 and measured by a current value measurement device, or the rotation speed of the rotor 4 measured by a rotation speed sensor 43 falls outside a normal value range. The pump control device 6 is a computer system including a CPU, a storage device such as a ROM, various interfaces, and the like.

The vacuum pump 1 includes multiple bearings 41A to 41E, the motor 42, and the rotation speed sensor 43. The multiple bearings 41A to 41E are attached to the shaft 21 housed in the base 3. The multiple bearings 41A to 41E rotatably support the rotor 4. The bearings 41A, 41E are, for example, ball bearings. On the other hand, the other bearings 41B to 41D are magnetic bearings. Each of the bearings 41B to 41D which are the magnetic bearings includes a bearing electromagnet and the displacement sensors 44A to 44C (FIG. 3), and the displacement sensors 44A to 44C detect, e.g., the levitation position of the shaft 21.

The motor 42 rotatably drives the rotor 4. The motor 42 includes a motor rotor 42A and a motor stator 42B. The motor rotor 42A is attached to the shaft 21. The motor stator 42B is attached to the base 3. The motor stator 42B is arranged so as to face the motor rotor 42A. A motor current measurement device 45 (FIG. 3) configured to measure the value of current supplied to the motor 42 is connected to the motor 42. The rotation speed sensor 43 measures the rotation speed of the shaft 21 (i.e., the rotor 4).

A heater 51 and a not-shown coolant pipe for controlling the temperature of the base 3 are provided on an outer wall of the base 3. The temperature of the base 3 is detected by a temperature sensor 52. On the basis of the temperature detected by the temperature sensor 52, the temperature of the base 3 is controlled by control of balance between heating of the base 3 by the heater 51 and cooling of the base 3 by coolant flowing in the coolant pipe. A heater current measurement device 53 (FIG. 3) configured to measure a current supplied to the heater 51 is connected to the heater 51.

In the vacuum pump 1, the multiple stages of the rotor blades 22 and the multiple stages of the stator blades 31 form a turbo-molecular pump portion. The rotor cylindrical portion 23 and the stator cylindrical portion 32 form a screw groove pump portion. In the vacuum pump 1, the rotor 4 is rotated by the motor 42, and accordingly, gas flows into the first internal space SP1 through the suction port 13. The gas in the first internal space SP1 passes through the turbo-molecular pump portion and the screw groove pump portion, and is pumped into the second internal space SP2. The gas in the second internal space SP2 is pumped out through the exhaust port 16. As a result, the inside of the pumping target attached to the suction port 13 is brought into a high vacuum state.

Configuration of Pump Control Device

Figure 3:
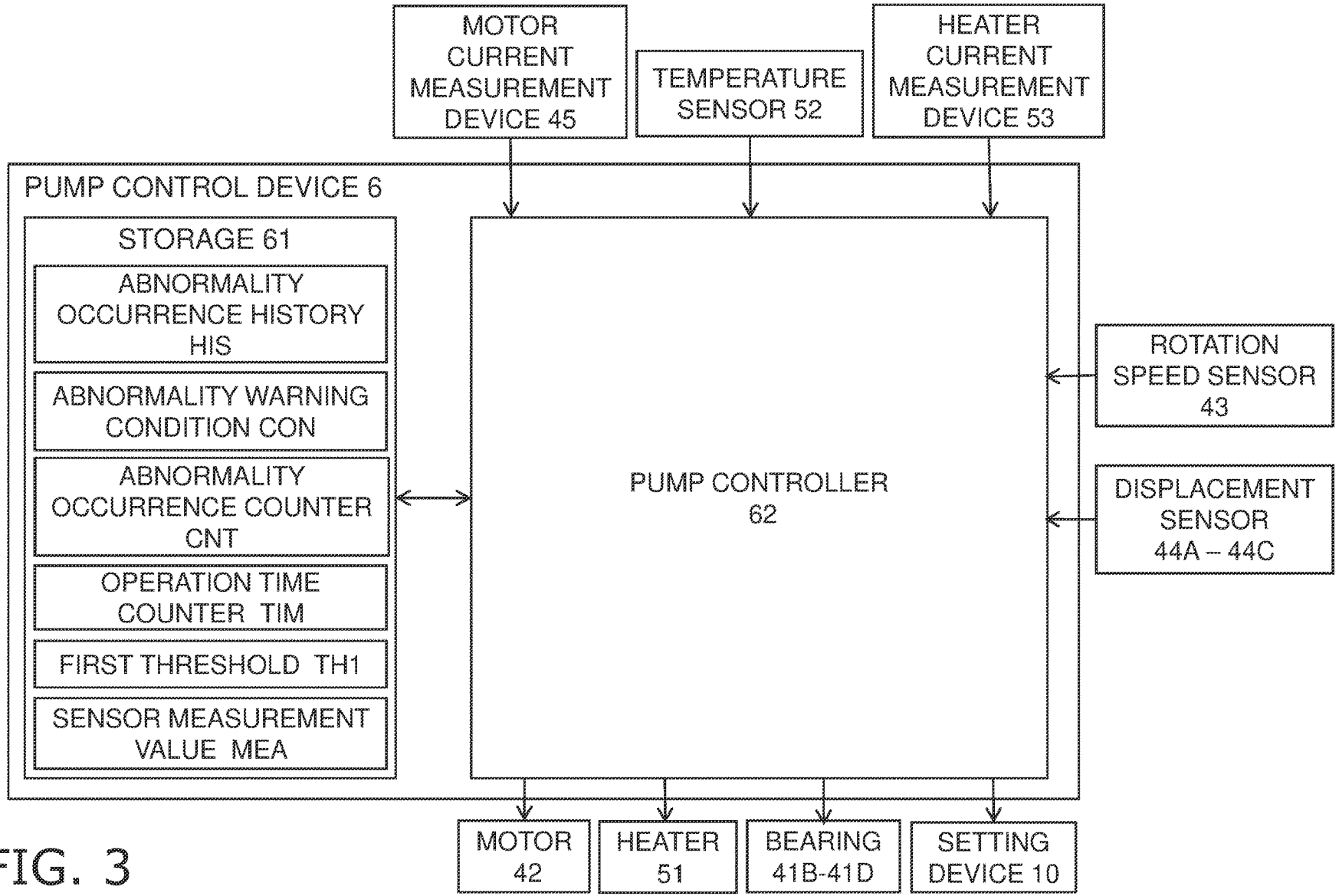
FIG. 3 is a diagram showing the configuration of a pump control device.

The configuration of the pump control device 6 will be described with reference to FIG. 3. FIG. 3 is a diagram showing the configuration of the pump control device 6. The pump control device 6 has a storage 61 and a pump controller 62. The storage 61 is part or the entirety of a storage area provided in the storage device forming the pump control device 6. The storage 61 stores various parameters regarding the vacuum pump 1, a program for controlling the vacuum pump 1, and the like. Specifically, the storage 61 stores an abnormality occurrence history HIS, an abnormality warning condition CON, an abnormality occurrence counter CNT, an operation time counter TIM, a first threshold TH1, and a sensor measurement value MEA.

The abnormality occurrence history HIS includes the history of occurrence of the abnormality occurred in the vacuum pump 1. As the abnormality occurrence history HIS, the type of abnormality occurred and the time of occurrence of the abnormality are stored in association with each other.

The abnormality warning condition CON includes a condition for issuing a warning about the abnormality occurred in the vacuum pump 1. Specifically, the abnormality warning condition CON includes conditions for issuing warnings about the following abnormalities.

The abnormality warning condition CON includes a condition for issuing a warning about an abnormality in the rotation speed of the rotor 4 when the rotation speed of the rotor 4 measured by the rotation speed sensor 43 reaches a predetermined speed or less. The abnormality in the rotation speed is an abnormality regarding the load of the vacuum pump 1, and indicates that the vacuum pump 1 is in an overload state. The "overload state" means a state in which the torque of the motor 42 necessary for rotating the rotor 4 to a set rotation speed is excessively higher than a normal torque. The overload state of the vacuum pump 1 indicates a state in which a great amount of product is accumulated inside the vacuum pump 1, for example. If this state continues for a long period of time, there is a probability that failure leading to damage of the rotor blade 22 of the vacuum pump 1 is occurred due to contact of the accumulated product with the rotor blade 22.

The abnormality warning condition CON includes a condition for issuing a warning about an abnormality in the position of the shaft 21 (rotor 4) when the position of the shaft 21 measured by the displacement sensors 44A to 44C varies within a predetermined variation range or more or the position of the shaft 21 shifts from the axis A1 within a predetermined range. The abnormality in the position of the shaft 21 is an abnormality regarding vibration of the vacuum pump 1, and means a state in which the vacuum pump 1 vibrates. In a case where the vacuum pump 1 vibrates, there is a probability that the rotor blade 22 of the vacuum pump 1 contacts other components (e.g., stator blade 31), for example. As a result, if the vacuum pump 1 vibrates, there is a probability that the rotor blade 22 (and the stator blade 31) is damaged.

The abnormality warning condition CON includes a condition for issuing a warning about an abnormality in the current of the motor 42 when the current value of the motor 42 measured by the motor current measurement device 45 reaches a predetermined value or more. The abnormality in the current of the motor 42 indicates that the motor 42 operates with an excessive torque. That is, the abnormality in the current of the motor 42 is an abnormality regarding the load of the vacuum pump 1, and indicates that the vacuum pump 1 is in the overload state.

The abnormality warning condition CON includes a condition for issuing a warning about an abnormality regarding the temperature of the vacuum pump 1 when the temperature of the base 3 measured by the temperature sensor 52 is a predetermined temperature or less and/or the current value of the heater 51 measured by the heater current measurement device 53 is a predetermined value or less. The abnormality regarding the temperature of the vacuum pumps 1 indicates a state in which the temperature of the vacuum pump 1 cannot be properly adjusted. If the temperature of the vacuum pump 1 is not properly adjusted, there is a probability that a product is accumulated inside the vacuum pump 1 and the rotor blade 22 is damaged due to contact of the product with the rotor blade 22. The abnormality regarding the temperature is often occurred, for example, due to disconnection of the heater 51, a failure to connect the heater 51, or failure of the temperature sensor 52.

The abnormality occurrence counter CNT is information indicating the number of times of occurrence of the abnormality. Specifically, the abnormality occurrence counter CNT indicates the number of times of occurrence of each of the abnormality regarding the load of the vacuum pump 1 (i.e., the abnormality regarding the rotation speed of the rotor 4, the abnormality regarding the current of the motor 42), the abnormality regarding vibration of the vacuum pump 1, and the abnormality regarding the temperature of the vacuum pump 1. The operation time counter TIM records a time elapsed after the initial start of operation of the vacuum pump 1.

The first threshold TH1 is set for the number of times of occurrence of a particular abnormality for issuing the alarm in the vacuum pump 1. That is, when the number of times of occurrence of the particular abnormality exceeds the first threshold TH1, the alarm is issued. The above-described particular abnormality is, for example, the abnormality regarding vibration of the vacuum pump 1, the abnormality regarding the current of the motor 42, the abnormality regarding the temperature of the vacuum pump 1, and/or the abnormality regarding the rotation speed of the rotor 4.

As the sensor measurement value MEA, the measurement value of the sensor provided in the vacuum pump 1 is recorded. Specifically, the sensor measurement value MEA is the rotation speed of the rotor 4 measured by the rotation speed sensor 43, the position of the shaft 21 measured by the displacement sensors 44A to 44C, the current value of the motor 42 measured by the motor current measurement device 45, the temperature of the base 3 measured by the temperature sensor 52, and/or the current value of the heater 51 measured by the heater current measurement device 53.

The pump controller 62 is a hardware including the CPU and various interfaces forming the pump control device 6, and executes control of the vacuum pump 1. The pump controller 62 executes the program stored in the storage 61 to implement a function regarding the control of the vacuum pump 1. Some functions may be implemented by hardware included in the pump controller 62.

Setting Device

Figure 4:
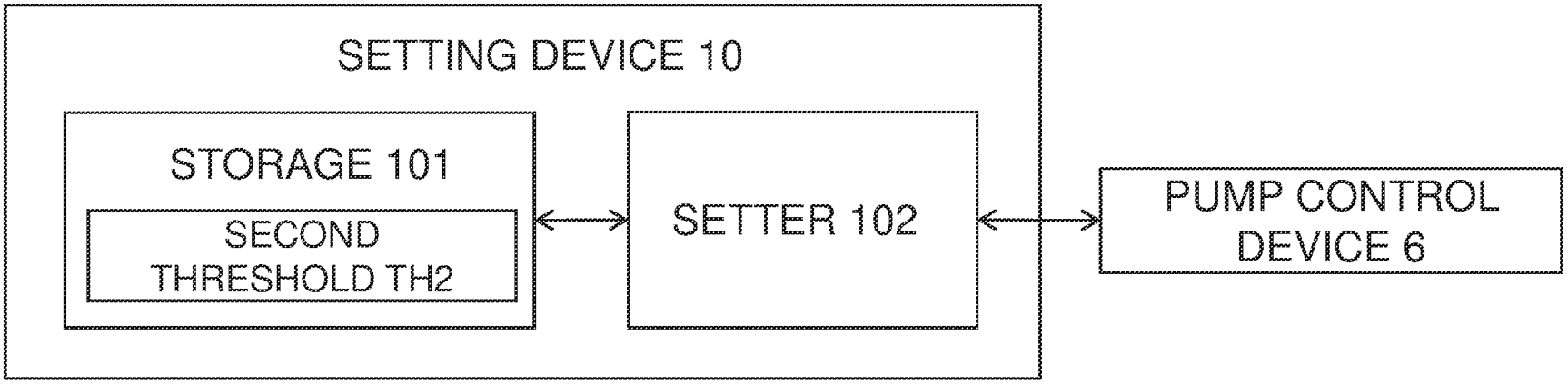
FIG. 4 is a diagram showing the configuration of a setting device.

Hereinafter, the configuration of the setting device 10 will be described with reference to FIG. 4. FIG. 4 is a diagram showing the configuration of the setting device 10. The setting device 10 has a storage 101 and a setter 102. The storage 101 is part or the entirety of a storage area provided in the storage device forming the setting device 10. The storage 101 stores, e.g., a program for operating the setter 102. The storage 101 stores a second threshold TH2.

The second threshold TH2 is set for the measurement value of the sensor for determining whether or not there is a risk of damage of the vacuum pump 1. That is, in a case where the measurement value of any sensor has reached the second threshold TH2 or more, it is determined that there is the risk of damage of the vacuum pump 1. The second threshold TH2 is set, for example, for a value of variation in the position of the shaft 21 measured by the displacement sensors 44A to 44C (i.e., the degree of vibration of the rotor 4). That is, when the degree of vibration of the rotor 4 measured by the displacement sensors 44A to 44C reaches the second threshold TH2 or more, it is determined that there is the risk of damage of the vacuum pump 1. The second threshold TH2 may also be set for the other sensor measurement values.

The setter 102 is a hardware including the CPU and various interfaces forming the setting device 10, and implements a function regarding setting of the vacuum pump 1. The setter 102 executes the program stored in the storage 101 to implement the function regarding setting of the vacuum pump 1. Some functions may be implemented by hardware included in the setter 102.

The setter 102 can refer to the abnormality occurrence history HIS, the counter value of the abnormality occurrence counter CNT, the operation time counter TIM, the sensor measurement value MEA and the like stored in the storage 61 of the pump control device 6. The setter 102 can also output such referred information to an output device (for example, display or printer) of the setting device 10.

As described above, the setting device 10 having the above-described functions is provided separately from the pump control devices 6 of the vacuum pumps 1, and therefore, the multiple vacuum pumps 1 are easily managed and operation records of the multiple vacuum pumps 1 are easily aggregated. As a result, the first threshold TH1 can be efficiently set or changed for each of the multiple vacuum pumps 1, and can be more properly set or changed on the basis of a greater number of operation records.

Alarm Issuance Operation

Figure 5:
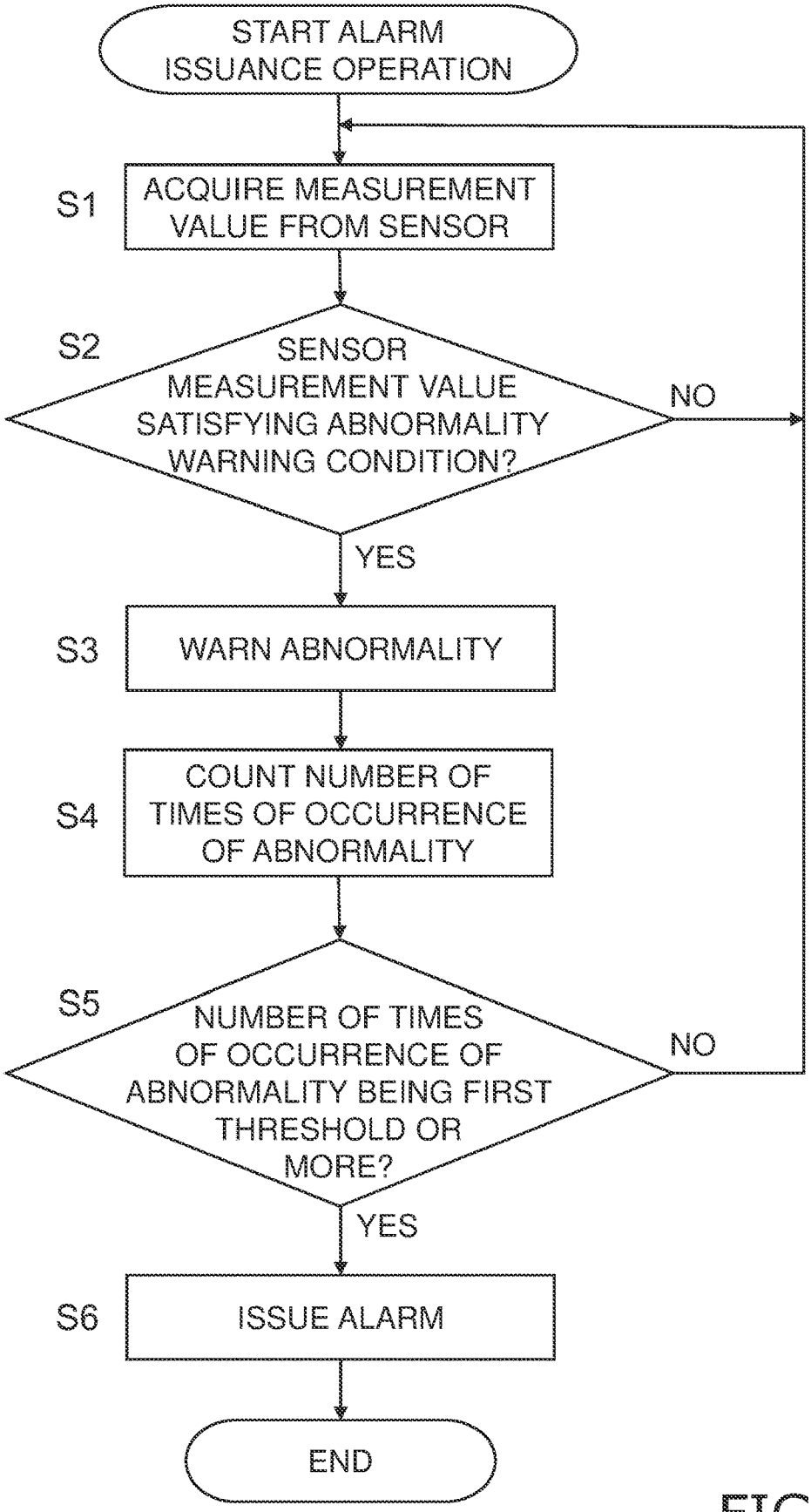
FIG. 5 is a flowchart showing alarm issuance operation.

Hereinafter, alarm issuance operation of the vacuum pump 1 will be described with reference to FIG. 5. FIG. 5 is a flowchart showing the alarm issuance operation. The alarm issuance operation is executed by the pump control device 6 of each vacuum pump 1 included in the vacuum pump system 100.

When the vacuum pump 1 is started, the pump controller 62 acquires the rotation speed of the rotor 4 measured by the rotation speed sensor 43, the position of the shaft 21 measured by the displacement sensors 44A to 44C, the current value of the motor 42 measured by the motor current measurement device 45, the temperature of the base 3 measured by the temperature sensor 52, and the current value of the heater 51 measured by the heater current measurement device 53 (Step S1).

Next, the pump controller 62 compares the rotation speed of the rotor 4, the position of the shaft 21, the current value of the motor 42, the temperature of the base 3, and the current value of the heater 51 acquired in Step S1 with the measurement values which are the abnormality warning conditions indicated by the abnormality warning condition CON (Step S2).

As a result of comparison, in a case where all the above-described sensor measurement values are neither coincident with the measurement values which are the abnormality warning conditions indicated by the abnormality warning condition CON, nor fall within the ranges of the measurement values which are the abnormality warning conditions ("No" in Step S2), the alarm issuance operation returns to Step S1. That is, the pump controller 62 continues operation of the vacuum pump 1.

On the other hand, in a case where any of the above-described sensor measurement values is coincident with the measurement value which is the abnormality warning condition indicated by the abnormality warning condition CON or falls within the range of the measurement value which is the abnormality warning condition ("Yes" in Step S2), the pump controller 62 issues the warning about the abnormality regarding the item (the rotation speed of the 4, vibration of the shaft 21, the current value of the motor 42, the temperature of the base 3, the current value of the heater 51) showing the measurement value satisfying the abnormality warning condition (Step S3). That is, the warning about the abnormality is issued when any of the above-described sensor measurement values satisfies the abnormality warning condition.

In a case where the warning about the abnormality has been issued, the pump controller 62 stores the warned abnormality in the abnormality occurrence history HIS. Specifically, the pump controller 62 stores the type of abnormality warned and the time of warning issuance about the abnormality in association with each other in the abnormality occurrence history HIS.

Also, in a case where the warning about the abnormality has been issued, the pump controller 62 may notify the warned abnormality by a method such as emission of sound from the pump control device 6, lighting of a warning light, or display of an indication of the warned abnormality on a display of the pump control device 6, for example. Alternatively, occurrence of the abnormality may only be stored without notification.

Thereafter, the pump controller 62 counts the number of times of occurrence of the abnormality (Step S4). Specifically, the pump controller 62 increases the value of the abnormality occurrence counter of the type warned in Step S3 by a value of 1 in the abnormality occurrence counter CNT.

After the number of times of occurrence of the abnormality has been counted, the pump controller 62 determines whether or not the number of times of occurrence of the abnormality warned in Step S3 has reached the first threshold TH1 or more for issuing the alarm regarding the abnormality (Step S5). In a case where the number of times of occurrence of the abnormality warned in Step S3 is less than the first threshold TH1 ("No" in Step S5), the alarm issuance operation returns to Step S1. That is, the pump controller 62 continues operation of the vacuum pump 1.

On the other hand, in a case where the number of times of occurrence of the abnormality warned in Step S3 is the first threshold TH1 or more ("Yes" in Step S5), the pump controller 62 issues the alarm regarding the abnormality warned in Step S3 (Step S6). That is, the alarm is issued when the number of times of occurrence (number of times of warning) of the abnormality (when the sensor measurement value satisfies the abnormality warning condition) reaches the first threshold TH1. The pump controller 62 can issue the alarm by a method such as emission of sound from the pump control device 6, lighting of a warning light, or display of an indication of the issued alarm on the display of the pump control device 6.

In the case of issuing the alarm, the pump controller 62 may change the sound emitted from the pump control device 6 or the color of the warning light to be lighted according to for which type of abnormality the alarm has been issued. Alternatively, the pump controller 62 may display, on the display, for which type of abnormality the alarm has been issued.

After issuance of the alarm, the pump controller 62 may stop the vacuum pump 1 at the timing of issuance of the alarm or a timing after a lapse of a predetermined time from issuance of the alarm. Alternatively, the pump controller 62 may stop the vacuum pump 1 according to user's operation after issuance of the alarm. With this configuration, action such as component replacement, repair, or cleaning can be taken against the abnormality occurred in the vacuum pump 1 after issuance of the alarm. After certain action has been taken in response to issuance of the alarm, the counter value of the abnormality occurrence counter CNT may be reset (e.g., set to zero).

By execution of Steps S1 to S6 above, the vacuum pump 1 issues the warning about the abnormality in a case where there is the abnormality in the measurement value of the sensor provided in the vacuum pump 1, and issues the alarm to notify the user of a great number of times of occurrence of the abnormality in a case where the number of times of occurrence of the abnormality increases beyond the first threshold TH1.

First Threshold Setting Operation

Hereinafter, an operation of setting or changing the first threshold TH1 in the vacuum pump system 100 will be described. The operation of setting or changing the first threshold TH1 is mainly executed in the setting device 10 included in the vacuum pump system 100.

For example, for a vacuum pump 1 with less operation records, such as a new product, there are few records on the necessity of issuance of an alarm according to the number of times of occurrence of an abnormality. For this reason, it is difficult to determine a first threshold TH1 for such a vacuum pump 1 on the basis of, e.g., experience. Moreover, in a case where the first threshold TH1 is a fixed value determined on the basis of, e.g., records of other vacuum pumps, the alarm cannot be issued at a proper timing in some cases. For example, in a vacuum pump 1 of which the number of times of occurrence of an abnormality is less than expected, no alarm is issued in some cases even when an operation time of the vacuum pump 1 reaches a time at which maintenance (overhaul) for the vacuum pump 1 is required. That is, even after the maintenance timing, the vacuum pump 1 is operated without maintenance in some cases.

In order to solve these problems, the setting device 10 determines, on the basis of an operation state of the vacuum pump, whether or not the first threshold TH1 needs to be set or changed, and if determining that the first threshold TH1 needs to be set or changed, sets or changes the first threshold TH1. The operation state of the vacuum pump means a measurement value of an arbitrary sensor or measurement device provided in the vacuum pump, and for example, is the rotation speed of the rotor 4 measured by the rotation speed sensor 43, the position of the shaft 21 measured by the displacement sensors 44A to 44C, the current value of the motor 42 measured by the motor current measurement device 45, the temperature of the base 3 measured by the temperature sensor 52, and/or the current value of the heater 51 measured by the heater current measurement device 53. Specifically, the setting device 10 determines, on the basis of the history of occurrence of the abnormality in the vacuum pump, whether or not the first threshold TH1 needs to be set or changed, and if determining that the first threshold TH1 needs to be set or changed, sets or changes the first threshold TH1. More specifically, the setting device 10 calculates a predicted value (referred to as a "predicted number of times of occurrence") of the number of times of occurrence of the abnormality at the proper timing of issuance of the alarm from an actual number of times of occurrence of the abnormality in the vacuum pump 1 before the proper timing of issuance of the alarm, and on the basis of the calculated predicted number of times of occurrence, sets or changes the first threshold TH1.

The timing of issuance of the alarm can be determined with reference to the operation time of the vacuum pump 1. Specifically, the timing of issuance of the alarm can be a timing of the operation time of the vacuum pump 1 reaching a second time or a time close thereto, for example. The second time can be set, for example, to 40000 hours, but the present disclosure is not limited to above and an arbitrary time can be set as necessary according to the vacuum pump 1.

The operation of setting or changing the first threshold TH1 is executed, for example, when the operation time of the vacuum pump 1 reaches a first time shorter than the above-described second time. That is, the predicted number of times of occurrence is calculated on the basis of the number of times of occurrence of the abnormality when the operation time of the vacuum pump 1 reaches the first time. The first time may be, for example, the half of the second time.

Hereinafter, some examples of the operation of setting or changing the first threshold TH1 will be described, but are mere examples. On the basis of the operation examples described below, the first threshold TH1 can be set or changed as necessary for various types of abnormalities according to conditions different from those described below.

First Example of Operation of Setting or Changing First Threshold

Figure 6:
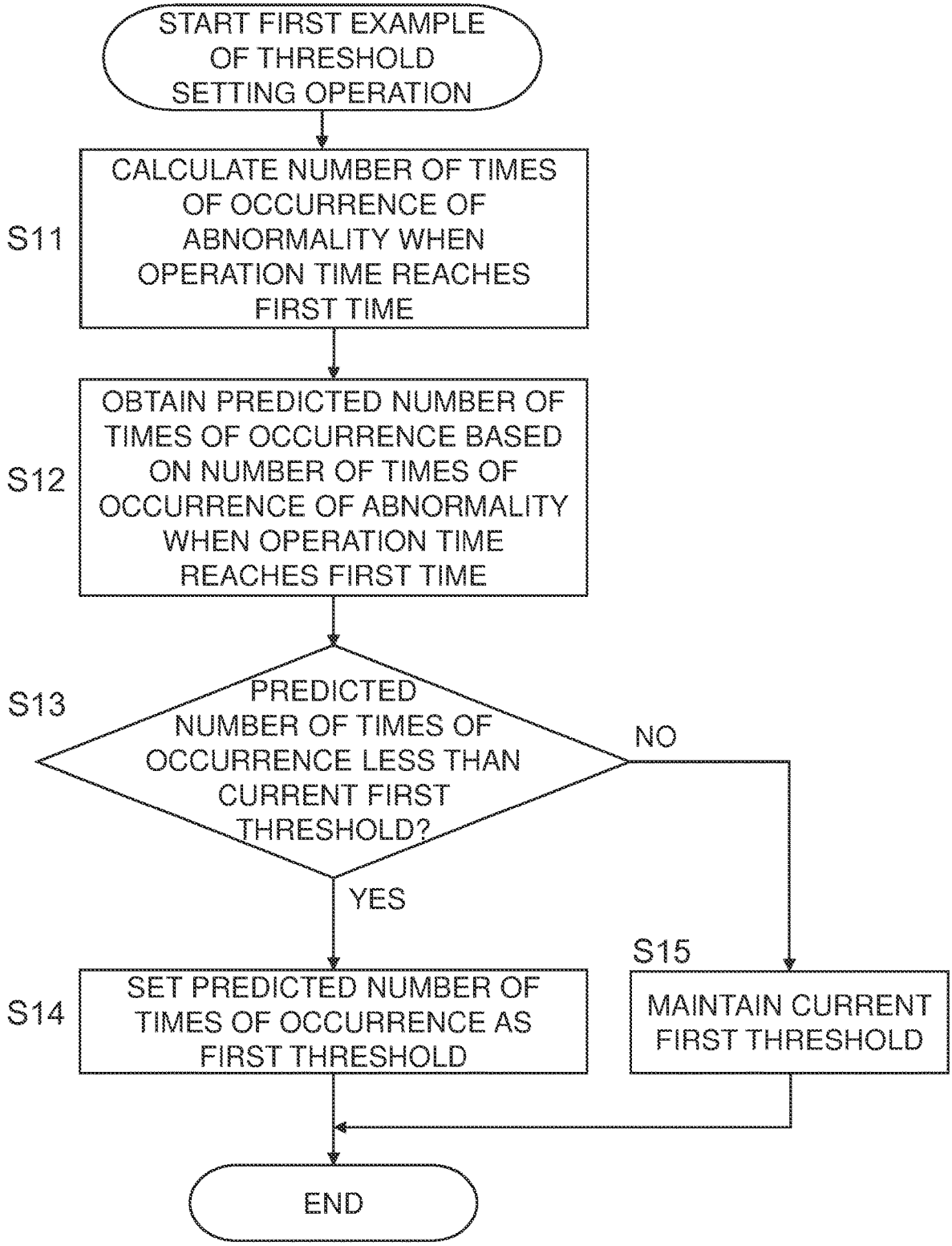
FIG. 6 is a flowchart showing a first example of an operation of setting a first threshold.

One example of an operation of setting or changing the first threshold TH1 will be described with reference to FIG. 6. FIG. 6 is a flowchart showing a first example of the operation of setting or changing the first threshold. The first example of the setting or changing operation described below may be used, for example, when the first threshold TH1 for issuing the alarm about the abnormality regarding the load of the vacuum pump 1 (abnormality regarding the rotation speed of the rotor 4) is set. Note that similar processing can also be executed for the alarms regarding the other abnormalities. The first example of the setting or changing operation is executed for one vacuum pump 1 included in the vacuum pump system 100.

The setter 102 of the setting device 10 first refers to the operation time counter TIM stored in the storage 61 of the pump control device 6, and checks whether or not the current operation time of the vacuum pump 1 targeted for setting or changing of the first threshold TH1 has reached the first time (i.e., whether or not the current time is a timing of executing the operation of setting or changing the first threshold TH1). In a case where the operation time of the vacuum pump 1 does not reach the first time, the setter 102 stands by without executing the setting or changing operation while executing other types of operation, for example. On the other hand, in a case where the operation time of the vacuum pump 1 has reached the first time, the setter 102 starts the operation of setting or changing the first threshold TH1.

After the start of the setting or changing operation, the setter 102 first calculates the number of times of occurrence of the abnormality (e.g., the abnormality regarding the load of the vacuum pump 1) when the operation time reaches the first time (Step S11). Specifically, the setter 102 refers to the abnormality occurrence history HIS stored in the storage 61 of the pump control device 6, and for the abnormality targeted for setting or changing of the first threshold TH1, counts the number of times of occurrence of the abnormality until the current time after the start of operation of the vacuum pump 1.

After calculation of the number of times of occurrence of the abnormality until the operation time reaches the first time, the setter 102 predicts, as the predicted number of times of occurrence, the number of times of occurrence of the abnormality when the operation time reaches the second time (i.e., at the timing of issuance of the alarm) based on the number of times of occurrence of the abnormality until the first time (Step S12). Specifically, the setter 102 can calculate the predicted number of times of occurrence from an expression of (Number of Times of Occurrence of Abnormality until First Time)×(Second Time/First Time), for example. More specifically, in a case where the first time is, for example, the half of the second time, the number of times obtained by doubling of the number of times of occurrence of the abnormality until the first time can be calculated as the predicted number of times of occurrence.

Next, the setter 102 sets or changes the first threshold TH1 on the basis of the predicted number of times of occurrence calculated in Step S12. Specifically, the first threshold TH1 is set or changed as follows. The setter 102 first compares the predicted number of times of occurrence with the current first threshold TH1 stored in the storage 61 of the pump control device 6, and determines whether or not the predicted number of times of occurrence is less than the current first threshold TH1 (Step S13). That is, the setter 102 determines whether or not the first threshold TH1 needs to be changed.

In a case where the predicted number of times of occurrence is less than the current first threshold TH1 ("Yes" in Step S13), the setter 102 decreases a new first threshold TH1 as compared to the current first threshold TH1 stored in the storage 61. Specifically, the setter 102 sets the predicted number of times of occurrence as the new first threshold TH1 (Step S14). More specifically, the setter 102 transmits, as the new first threshold TH1, the predicted number of times of occurrence to the pump control device 6. The pump controller 62 of the pump control device 6 having received the predicted number of times of occurrence stores, as the new first threshold TH1, the received predicted number of times of occurrence in the storage 61.

On the other hand, in a case where the predicted number of times of occurrence is the current first threshold TH1 or more ("No" in Step S13), the setter 102 determines that the current first threshold TH1 is maintained (Step S15). That is, the setter 102 does not update the first threshold TH1 stored in the storage 61.

A smaller predicated value (predicted number of times of occurrence) of the number of times of occurrence of the abnormality when the operation time reaches the second time than the current first threshold TH1 means that the frequency of occurrence of the abnormality is less than expected and there is a probability that the number of times of occurrence of the abnormality does not reach the current first threshold TH1 even when the determined timing of issuance of the alarm comes. Thus, in a case where the predicted value (predicted number of times of occurrence) of the number of times of occurrence of the abnormality is less than the current first threshold TH1, the predicted number of times of occurrence (i.e., a smaller number of times than the current first threshold TH1) is set as the new first threshold TH1 as described above, and therefore, the number of times of occurrence of the abnormality reaches the first threshold TH1 at the determined proper timing of issuance of the alarm (i.e., a timing of the operation time reaching the second time) or a timing close thereto. As a result, the alarm can be issued at the proper timing to prompt the user to take action such as maintenance.

On the other hand, the predicted number of times of occurrence which is the current first threshold TH1 or more means that the frequency of occurrence of the abnormality is greater than expected and there is a probability that the number of times of occurrence of the abnormality reaches the current first threshold TH1 before the determined timing of issuance of the alarm and the alarm is issued before the determined timing of issuance of the alarm. The current first threshold TH1 is not updated in a case where the predicted value (predicted number of times of occurrence) of the number of times of occurrence of the abnormality is the current first threshold TH1 or more, and therefore, the alarm can be issued before the determined timing of issuance of the alarm to prompt the user to take action, such as maintenance, at an earlier stage.

Second Example of Operation of Setting or Changing First Threshold

Figure 7:
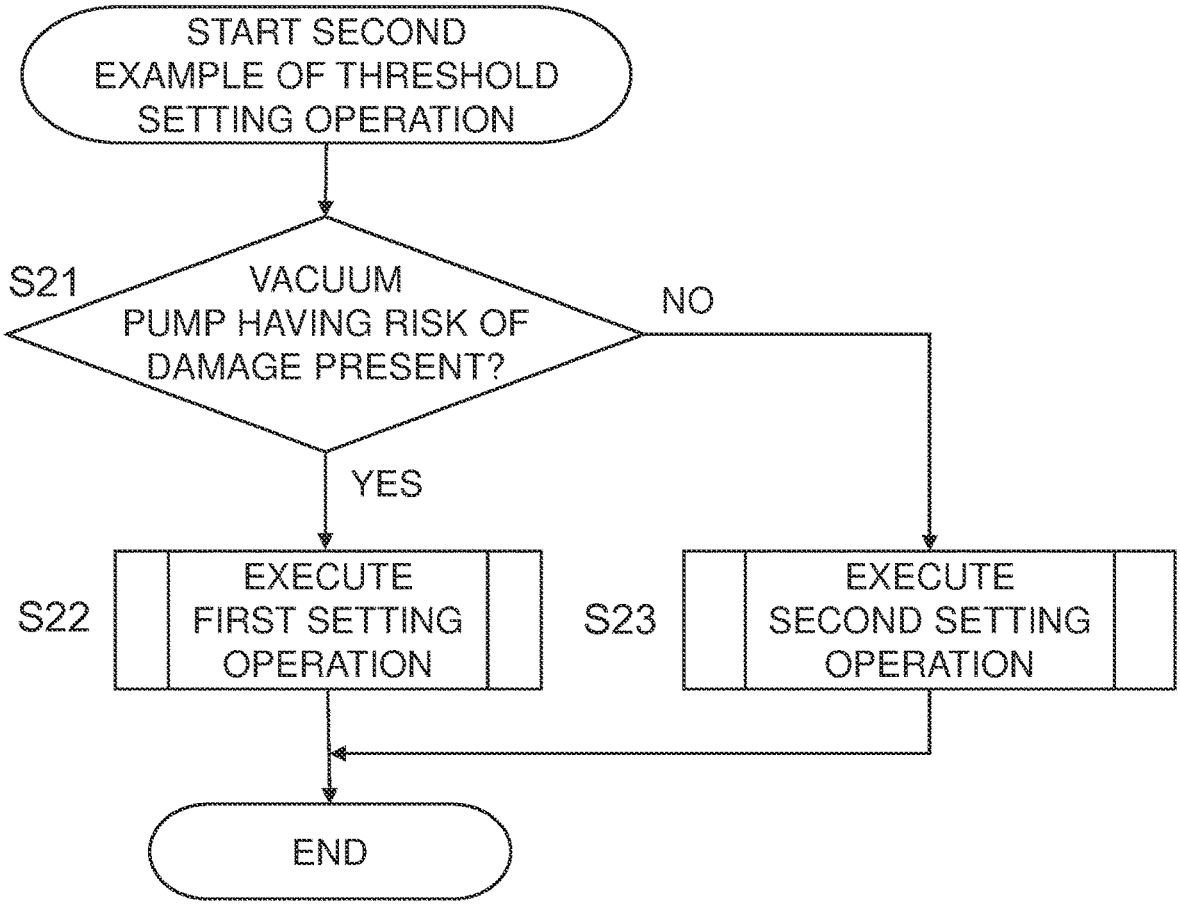
FIG. 7 is a flowchart showing a second example of the operation of setting a first threshold.

Another example of the operation of setting or changing the first threshold TH1 will be described with reference to FIG. 7. FIG. 7 is a flowchart showing a second example of the operation of setting or changing the first threshold TH1. The second example of the setting or changing operation described below may be used, for example, when the first threshold TH1 for issuing the alarm about the abnormality regarding vibration of the vacuum pump 1 is set. Note that similar processing can also be executed for the alarms regarding the other abnormalities. The second example of the setting or changing operation is executed for the multiple vacuum pumps 1 included in the vacuum pump system 100.

In the second example of the setting or changing operation, the setter 102 first determines whether or not there is a vacuum pump 1 having the risk of damage among the multiple vacuum pumps 1 targeted for setting or changing of the first threshold TH1 (Step S21). Here, the "vacuum pump 1 having the risk of damage" indicates a vacuum pump 1 which is highly likely to be damaged as compared to the other vacuum pumps 1. Specifically, the "vacuum pump 1 having the risk of damage" indicates a vacuum pump 1 having a greater sensor measurement value than those of the other vacuum pumps 1.

Specifically, the setter 102 acquires the value of variation in the position of the shaft 21 measured by the displacement sensors 44A to 44C from each of the multiple vacuum pumps 1, and for a vacuum pump 1 having a value of variation which is the second threshold TH2 or more, determines that there is the risk of damage. A great value of variation in the position of the shaft 21 means that the shaft 21 greatly vibrates. In a case where the shaft 21 greatly vibrates, e.g., a product accumulated in the rotor 4 is likely to contact the other components, and therefore, the risk of damage of the vacuum pump 1 is high. Moreover, in a case where the shaft 21 greatly vibrates, the entirety of the vacuum pump 1 also greatly vibrates, and therefore, the risk of damage is high.

In a case where there is the vacuum pump 1 having the value of variation, which is the second threshold TH2 or more, in the position of the shaft 21, i.e., a case where there is the vacuum pump 1 having the risk of damage ("Yes" in Step S21), the operation of setting or changing the first threshold TH1 proceeds to Step S22. In Step S22, the first threshold TH1 less than those of the other vacuum pumps 1 is set for a vacuum pump 1 having the risk of damage because the value of variation in the position of the shaft 21 is greater than those of the other vacuum pumps 1, but having an average predicted number of times of occurrence less than the current first threshold TH1 and the number of times of occurrence of the abnormality less than an average value. This operation of setting or changing the first threshold TH1 will be referred to as "first setting operation." A specific processing flow of the first setting operation will be described later in detail.

On the other hand, in a case where there is no vacuum pump 1 having the value of variation, which is the second threshold TH2 or more, in the position of the shaft 21 ("No" in Step S21), i.e., a case where there is no vacuum pump 1 having the risk of damage, the operation of setting or changing the first threshold TH1 proceeds to Step S23. In Step S23, the first threshold TH1 greater than those of the other vacuum pumps 1 is set for a vacuum pump 1 having the average predicted number of times of occurrence which is the current first threshold TH1 or more and the number of times of occurrence of the abnormality which is the average value or more. This operation of setting or changing the first threshold TH1 will be referred to as "second setting operation." A specific processing flow of the second setting operation will be described later in detail.

As described above, the first threshold TH1 is set on the basis of the operation records obtained from the multiple vacuum pumps 1 so that the first threshold TH1 can be more properly set. This is because of the following reason. The operation records being obtained from the multiple vacuum pumps 1 mean that the operation records including a greater amount of information are obtained as compared to the operation records obtained from one vacuum pump 1. If the operation records including a greater amount of information are obtained from the vacuum pumps 1, the first threshold TH1 reflecting the characteristics (e.g., an abnormality occurrence trend) of the vacuum pump 1 can be properly set.

A method for setting or changing the first threshold TH1 is changed according to whether or not there is the vacuum pump 1 having the risk of damage, and therefore, the first threshold TH1 can be set such that the alarm is issued at a more-proper timing.

First Setting Operation

Figure 8:
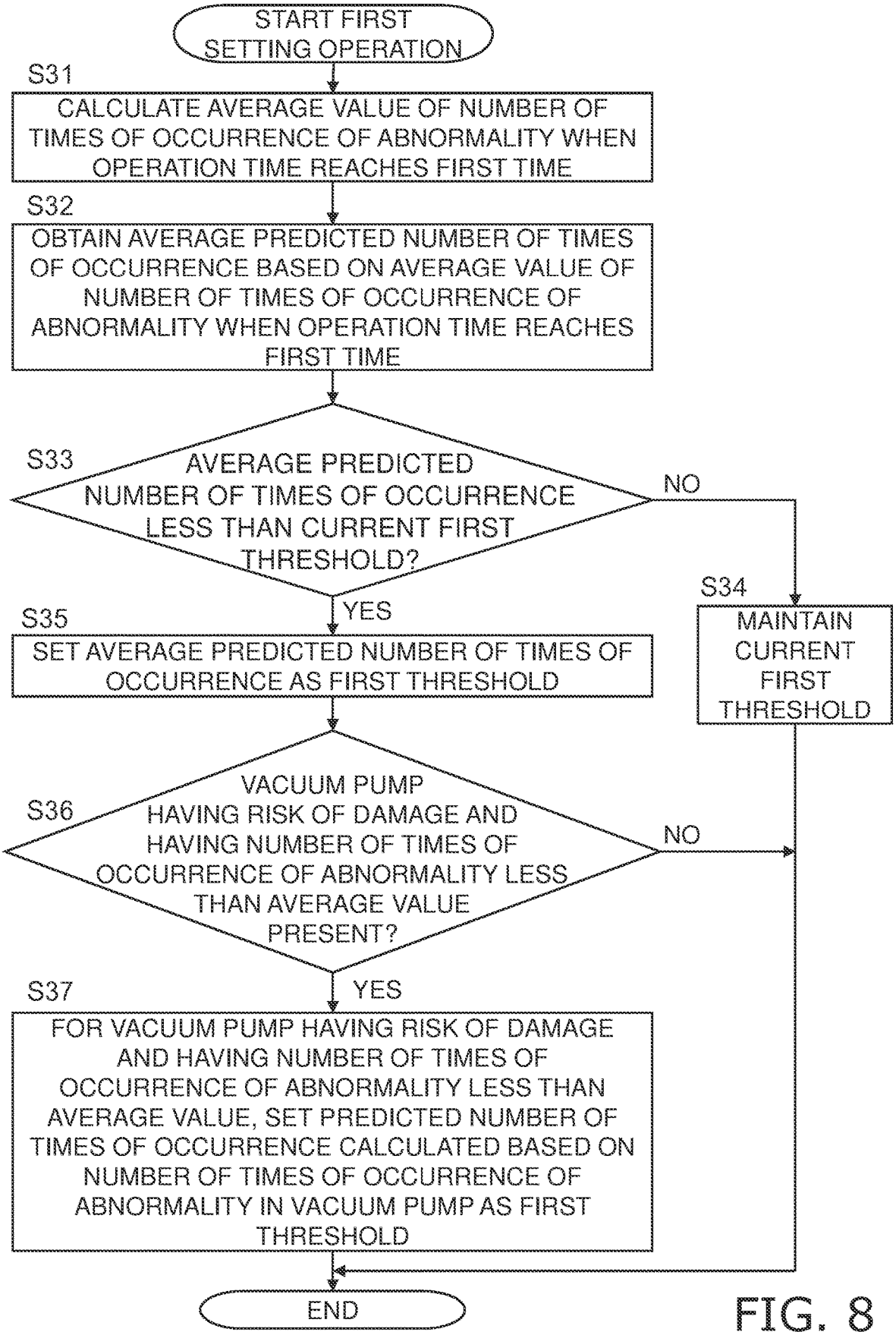
FIG. 8 is a flowchart showing first setting operation.

Hereinafter, the operation (first setting operation) of setting or changing the first threshold TH1 in a case where there is the vacuum pump 1 having the risk of damage will be described with reference to FIG. 8. FIG. 8 is a flowchart showing the first setting operation.

The setter 102 calculates the average value of the number of times of occurrence of the abnormality when the operation time reaches the first time (Step S31). Specifically, for each of the multiple vacuum pumps 1, the setter 102 refers to the abnormality occurrence history HIS stored in the storage 61 of the pump control device 6, and for the abnormality targeted for setting or changing of the first threshold TH1, counts the number of times of occurrence of the abnormality until the current time after the start of operation of the vacuum pump 1. Thereafter, the setter 102 adds up the multiple numbers of times of occurrence of the abnormality counted for the multiple vacuum pumps 1, and divides the total of the multiple numbers of times of occurrence of the abnormality by the number of vacuum pumps 1 to calculate the average value of the number of times of occurrence of the abnormality.

After calculation of the average value of the number of times of occurrence of the abnormality, the setter 102 predicts, as the average predicted number of times of occurrence, the average value of the number of times of occurrence of the abnormality when the operation time reaches the second time on the basis of the average value of the number of times of occurrence of the abnormality counted in Step S31 (Step S32). Specifically, the setter 102 can calculate the average predicted number of times of occurrence from an expression of (Average Value of Number of Times of Occurrence of Abnormality until First Time)×(Second Time/First Time).

Next, for each of the multiple vacuum pumps 1, the setter 102 compares the average predicted number of times of occurrence with the current first threshold TH1 stored in the storage 61 of the pump control device 6 of the vacuum pump 1, and determines whether or not the average predicted number of times of occurrence is less than the current first threshold TH1 (Step S33).

In the case of the vacuum pump 1 having the average predicted number of times of occurrence which is the first threshold TH1 or more ("No" in Step S33), the setter 102 determines that the current first threshold TH1 for the vacuum pump 1 is maintained (Step S34). That is, the setter 102 does not update the first threshold TH1 stored in the storage 61.

On the other hand, in the case of the vacuum pump 1 having the average predicted number of times of occurrence less than the first threshold TH1 ("Yes" in Step S33), the setter 102 sets the average predicted number of times of occurrence as the new first threshold TH1 for the vacuum pump 1 (Step S35).

Thereafter, the setter 102 determines whether or not there is a vacuum pump 1 having the value of variation, which is the second threshold TH2 or more, in the position of the shaft 21 (i.e., having the risk of damage) and the number of times of occurrence of the abnormality which is less than the average value of the number of times of occurrence of the abnormality calculated in Step S31, among the vacuum pumps 1 having the average predicted numbers of times of occurrence less than the first thresholds TH1 stored in the storages 61 (Step S36).

In a case where there is a vacuum pump 1 having the risk of damage and having the number of times of occurrence of the abnormality less than the average value ("Yes" in Step S36), the setter 102 sets, for such a vacuum pump 1, the predicted number of times of occurrence calculated on the basis of the number of times of occurrence of the abnormality in the vacuum pump 1 as the new first threshold TH1 (Step S37).

On the other hand, in a case where there is no vacuum pump 1 having the risk of damage and having the number of times of occurrence of the abnormality less than the average value of the number of times of occurrence of the abnormality calculated in Step S31 ("No" in Step S36), the setter 102 determines that the first threshold TH1 set by execution of Steps S31 to S35 above is maintained.

As described above, for the vacuum pump 1 having the risk of damage and having the number of times of occurrence of the abnormality less than the average value, the predicted number of times of occurrence (i.e., the predicted number of times of occurrence less than the current first threshold TH1 and less than the average predicted number of times of occurrence) calculated on the basis of the number of times of occurrence of the abnormality in the vacuum pump 1 is set as the new first threshold TH1 so that the alarm can be issued at the proper timing.

For example, sometimes in a case where the average predicted number of times of occurrence is set as the new first threshold TH1 for the vacuum pump 1 having the number of times of occurrence of the abnormality less than the average value, even if there is the risk of damage, the number of times of occurrence of the abnormality does not reach the first threshold TH1 even when the proper timing of issuance of the alarm comes and no alarm is issued. As a result, there is a probability that operation of the vacuum pump 1 continues without action, such as maintenance, taken at the proper timing.

On the other hand, the threshold less than the average predicted number of times of occurrence is set as the new first threshold TH1 for the vacuum pump 1 having the number of times of occurrence of the abnormality less than the average value, and therefore, the number of times of occurrence of the abnormality reaches the first threshold TH1 at the proper timing of issuance of the alarm. As a result, for such a vacuum pump 1, the alarm is issued at the proper timing, and action such as maintenance can be taken at the proper timing.

Second Setting Operation

Figure 9:
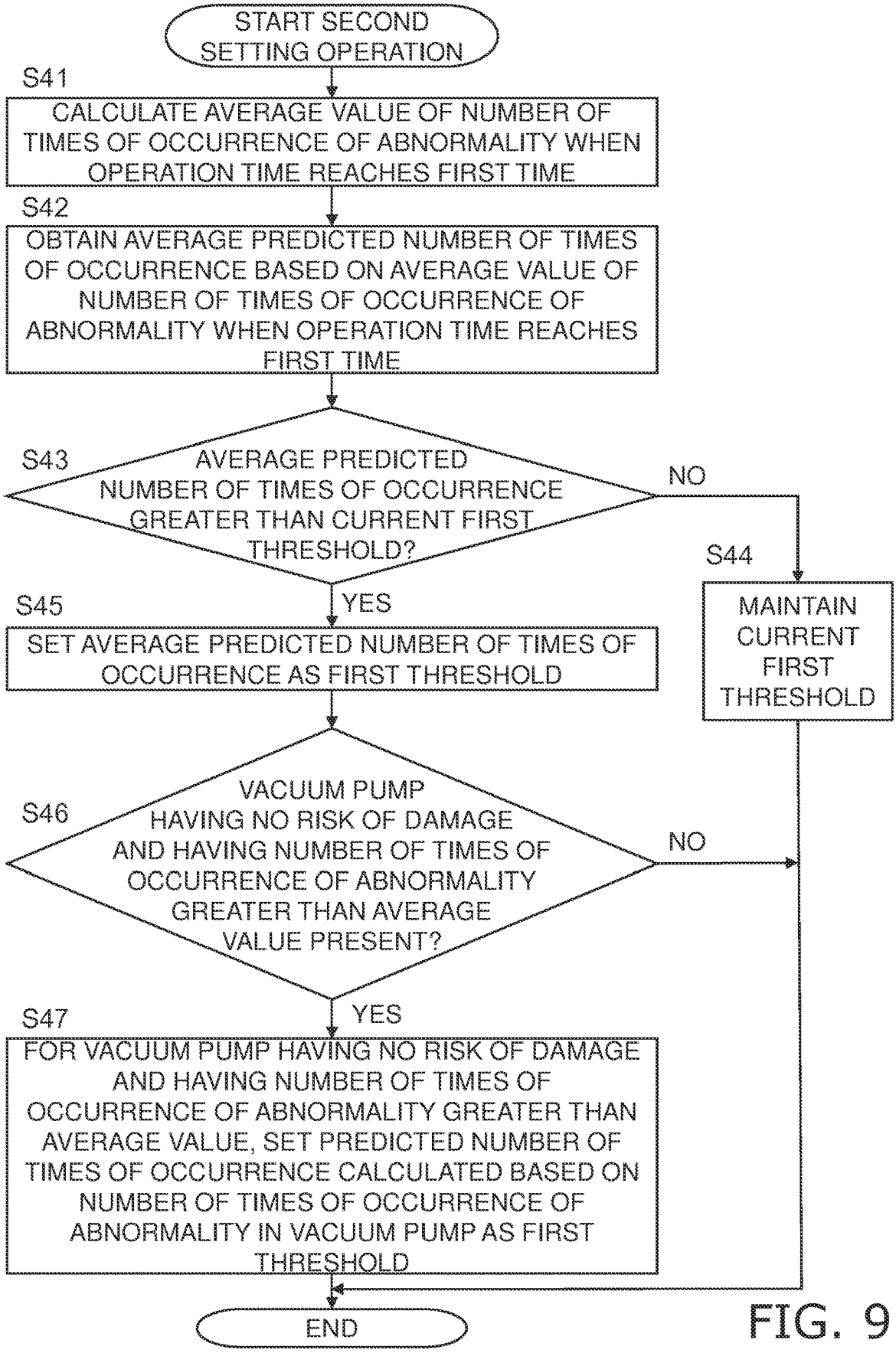
FIG. 9 is a flowchart showing second setting operation.

Hereinafter, the operation (second setting operation) of setting or changing the first threshold TH1 in a case where there is no risk of damage of the vacuum pump 1 will be described with reference to FIG. 9. FIG. 9 is a flowchart showing the second setting operation. The setter 102 first calculates the average value of the number of times of occurrence of the abnormality when the operation time reaches the first time (Step S41), and on the basis of the calculated average value of the number of times of occurrence of the abnormality, predicts the average value of the number of times of occurrence of the abnormality when the operation time reaches the second time as the average predicted number of times of occurrence (Step S42). Operation in Steps S41 to S42 is similar to that in Steps S31 to S32 described above, and therefore, detailed description of the processing contents of Steps S41 to S42 will be omitted.

After prediction of the average predicted number of times of occurrence, the setter 102 compares the average predicted number of times of occurrence with the current first threshold TH1 stored in the storage 61 of the pump control device 6 of each vacuum pump 1, and determines whether or not the average predicted number of times of occurrence is greater than the current first threshold TH1 (Step S43).

In the case of a vacuum pump 1 having the average predicted number of times of occurrence which is the first threshold TH1 or less ("No" in Step S43), the setter 102 determines that the current first threshold TH1 of the vacuum pump 1 is maintained (Step S44). That is, the setter 102 does not update the first threshold TH1 stored in the storage 61.

On the other hand, in the case of a vacuum pump 1 having the average predicted number of times of occurrence greater than the first threshold TH1 ("Yes" in Step S43), the setter 102 sets, for such a vacuum pump 1, the average predicted number of times of occurrence as the new first threshold TH1 (Step S45).

After execution of Step S45 above, the setter 102 determines whether or not there is a vacuum pump 1 having the number of times of occurrence of the abnormality greater than the average value among the vacuum pumps 1 having the average predicted numbers of times of occurrence greater than the first thresholds TH1 stored in the storage 61 (Step S46).

In a case where there is the vacuum pump 1 having the number of times of occurrence of the abnormality greater than the average value ("Yes" in Step S46), the setter 102 sets, for such a vacuum pump 1, the predicted number of times of occurrence (i.e., the predicted number of times of occurrence which is the current first threshold TH1 or more and is greater than average predicted number of times of occurrence) calculated on the basis of the number of times of occurrence of the abnormality in the vacuum pump 1 as the new first threshold TH1 (Step S47).

On the other hand, in a case where there is no vacuum pump 1 having the number of times of occurrence of the abnormality greater than the average value ("No" in Step S46), the setter 102 determines that the first threshold TH1 set by execution of Steps S41 to S45 above is maintained.

As described above, the predicted number of times of occurrence calculated on the basis of the number of times of occurrence of the abnormality in the vacuum pump 1 is set as the new first threshold TH1 for the vacuum pump 1 having no risk of damage and having the number of times of occurrence of the abnormality greater than the average value so that the alarm can be issued at the proper timing. This is because the predicted number of times of occurrence calculated on the basis of the number of times of occurrence of the abnormality in the vacuum pump 1 is greater than the average predicted number of times of occurrence.

For example, sometimes in a case where the above-described average predicted number of times of occurrence is set as the new first threshold TH1 for the vacuum pump 1 having the number of times of occurrence of the abnormality greater than the average value, even if there is no risk of damage, the number of times of occurrence of the abnormality reaches the first threshold TH1 before the proper timing of issuance of the alarm. As a result, the alarm is sometimes issued before the proper timing of issuance of the alarm. That is, there is a probability that the alarm is issued although action such as maintenance does not need to be taken for the vacuum pump 1.

On the other hand, the predicted number of times of occurrence (greater than the average predicted number of times of occurrence) calculated on the basis of the number of times of occurrence of the abnormality in the vacuum pump 1 is set as the new first threshold TH1 for the vacuum pump 1 having the number of times of occurrence of the abnormality greater than the average value, and therefore, the number of times of occurrence of the abnormality reaches the first threshold TH1 at the proper timing of issuance of the alarm. As a result, the alarm is issued for such a vacuum pump 1 at the proper timing, and action such as maintenance can be taken at the proper timing.

One embodiment of the present disclosure has been described above, but the present disclosure is not limited to the above-described embodiment and various changes can be made without departing from the gist of the disclosure.

In the above-described setting or changing operation examples, there is the preset first threshold TH1, and the first threshold TH1 is changed or set as necessary by the setting or changing operation. The present disclosure is not limited to above, and the setter 102 may learn the abnormality occurrence trend, a trend of an increase/decrease in the measurement value obtained by the sensor provided in the vacuum pump 1, and the like, thereby setting or changing the first threshold TH1 on the basis of these learning results.

For example, the setter 102 predicts, as the predicted number of times of occurrence, the number of times of occurrence of the abnormality when the operation time reaches the second time from the abnormality occurrence trend, the trend of the increase/decrease in the sensor value, and the like, thereby setting or changing the predicted number of times of occurrence as the first threshold TH1.

In the above-described setting or changing operation, the operation of setting or changing the first threshold TH1 is executed only once before the operation time of the vacuum pump 1 reaches the second time. That is, the first time is one type of time (e.g., the half of the second time). However, the present disclosure is not limited to above, and the operation of setting or changing the first threshold TH1 may be executed multiple times before the operation time of the vacuum pump 1 reaches the second time. That is, the first time includes multiple types of time. For example, in a case where the abnormality occurrence trend (e.g., the frequency of occurrence) changes after execution of the operation of setting or changing the first threshold TH1, the operation of setting or changing the first threshold TH1 can be executed again.

The first example of the setting or changing operation above may be executed for the multiple vacuum pumps 1. The second example of the setting or changing operation above may be executed for one vacuum pump 1.

The first example of the setting or changing operation above may also be executed, for example, for the abnormalities (the abnormality regarding vibration of the vacuum pump 1, the abnormality regarding the temperature of the vacuum pump 1, and the like.) other than the abnormality regarding the load of the vacuum pump 1. The second example of the setting or changing operation may also be executed, for example, for the abnormalities (the abnormality regarding the load of the vacuum pump 1, the abnormality regarding the temperature of the vacuum pump 1, and the like.) other than the abnormality regarding vibration of the vacuum pump 1.

The functions of the setting device 10 described above may be implemented in the pump control device 6 of each vacuum pump 1. In this case, the setting device 10 is not necessarily provided.

In the vacuum pump 1 according to the above-described embodiment, the turbo-molecular pump portion may be omitted. That is, the vacuum pump 1 may be a screw groove pump.

Those skilled in the art understand that the above-described multiple exemplary embodiments are specific examples of the following aspects.

(First Aspect) A vacuum pump system is a system including a vacuum pump configured to pump gas by drive of a rotor by a motor. The vacuum pump system includes a storage, a controller, and a setter. The storage stores a first threshold for the number of times of occurrence of an abnormality for outputting an alarm. The controller counts the number of times of occurrence of the abnormality occurred in the vacuum pump, determines whether or not the number of times of occurrence of the abnormality is the first threshold or more, and outputs the alarm in a case where the number of times of occurrence of the abnormality is the first threshold or more. The setter sets or changes the first threshold on the basis of an operation state of the vacuum pump.

In the vacuum pump system according to the first aspect, the alarm is output when the number of times of occurrence of the abnormality is the first threshold or more. In the vacuum pump system according to the first aspect, the first threshold suitable for an individual vacuum pump can be set with reference to an actual operation state of the vacuum pump, and therefore, the alarm can be output at a proper timing.

(Second Aspect) In the vacuum pump system according to the first aspect, the setter may set or change the first threshold on the basis of the history of occurrence of the abnormality. In this case, the first threshold suitable for the individual vacuum pump can be set with reference to an actual abnormality occurrence history of the vacuum pump, and therefore, the alarm can be output at the proper timing.

(Third Aspect) In the vacuum pump system according to the first or second aspect, the setter may predict, on the basis of the number of times of occurrence of the abnormality when an operation time of the vacuum pump reaches a first time, the number of times of occurrence of the abnormality when the operation time of the vacuum pump reaches a second time longer than the first time as a predicted number of times of occurrence. Moreover, the setter may set or change the first threshold on the basis of the predicted number of times of occurrence. In this case, the setter predicts, on the basis of the number of times of occurrence of the abnormality when the operation time of the vacuum pump reaches the first time, the predicated value (i.e., the predicted number of times of occurrence) of the number of times of occurrence of the abnormality at the second time after the first time, and sets the first threshold on the basis of the predicated value. The predicted number of times of occurrence is obtained on the basis of an actual number of times of occurrence of the abnormality occurred in the vacuum pump. Thus, the predicted number of times of occurrence is obtained as a value close to an actual number of times of occurrence of the abnormality when the operation time reaches the second time. Thus, the first threshold is set on the basis of the predicted number of times of occurrence so that the alarm can be output at the proper timing.

(Fourth Aspect) In the vacuum pump system according to the third aspect, in a case where the predicted number of times of occurrence is less than the first threshold stored in the storage, the setter may set the predicted number of times of occurrence as a new first threshold. In the vacuum pump system according to the fourth aspect, the alarm can be output at the proper timing even in a case where the frequency of occurrence of the abnormality is lower than expected in the vacuum pump.

(Fifth Aspect) In the vacuum pump system according to the third aspect, in a case where the predicted number of times of occurrence is the first threshold, which is stored in the storage, or more, the setter may determine that the first threshold stored in the storage is maintained. In the vacuum pump system according to the fifth aspect, for a vacuum pump 1 having a higher frequency of occurrence of the abnormality, the alarm can be issued at an earlier stage to prompt a user to take action, such as maintenance, at an earlier stage.

(Sixth Aspect) In the vacuum pump system according to the third aspect, the vacuum pump may have a measurer configured to measure the operation state of the vacuum pump. In this case, the setter may determine, on the basis of whether or not a measurement value sensed by the measurer is a second threshold or more, whether or not there is a risk of damage of the vacuum pump, and set or change the first threshold on the basis of the predicted number of times of occurrence and whether or not there is the risk of damage of the vacuum pump. In the vacuum pump system according to the sixth aspect, the first threshold can be set such that the alarm is output at a more-proper timing.

(Seventh Aspect) In the vacuum pump system according to the sixth aspect, the setter may set the predicted number of times of occurrence as a new first threshold in a case where it is determined that the measurement value is less than the second threshold, there is no risk of damage of vacuum pump, and the predicted number of times of occurrence is greater than the first threshold stored in the storage. In the vacuum pump system according to the seventh aspect, for a vacuum pump having no risk of damage, but having a high frequency of occurrence of the abnormality, the alarm can be output in the proper timing.

(Eighth Aspect) In the vacuum pump system according to the sixth or seventh aspect, the setter may set the predicted number of times of occurrence as the new first threshold in a case where it is determined that the measurement value is the second threshold or more, there is the risk of damage of the vacuum pump, and the predicted number of times of occurrence is less than the first threshold stored in the storage. In the vacuum pump system according to the eighth aspect, for a vacuum pump having the risk of damage, but having a low frequency of occurrence of the abnormality, the alarm can be output in the proper timing.

(Ninth Aspect) In the vacuum pump system according to any one of the first to eighth aspects, the abnormality may be at least one selected from an abnormality regarding vibration of the vacuum pump and an abnormality regarding a load of the vacuum pump. In the vacuum pump system according to the ninth aspect, the first threshold can be properly set for an abnormality easily leading to damage of the vacuum pump.

(Tenth Aspect) A control method according to a tenth aspect is a method for controlling a vacuum pump configured to pump gas by drive of a rotor by a motor. The control method includes counting the number of times of occurrence of an abnormality occurred in the vacuum pump, setting or changing a first threshold for the number of times of occurrence of the abnormality for outputting an alarm on the basis of an operation state of the vacuum pump, and outputting the alarm in a case where the number of times of occurrence of the abnormality is the first threshold or more.

In the control method according to the tenth aspect, the first threshold suitable for an individual vacuum pump can be set with reference to an actual operation state of the vacuum pump, and therefore, the alarm can be output at a proper timing.

Various embodiments and modifications have been described above, but the present disclosure is not limited to the contents of these embodiments and modifications. The embodiments and the modifications may be applied alone or in combination. Other aspects conceivable within the scope of the technical idea of the present disclosure are also included in the scope of the present disclosure.

What is claimed is:

1. A vacuum pump system including a vacuum pump configured to pump gas by drive of a rotor by a motor, comprising:

a storage storing a first threshold for a number of times of occurrence of an abnormality for outputting an alarm;

a controller configured to count the number of times of occurrence of the abnormality occurred in the vacuum pump, determine whether or not the number of times of occurrence of the abnormality is the first threshold or more, and output the alarm in a case where the number of times of occurrence of the abnormality is the first threshold or more; and a setter configured to set or change the first threshold on a basis of an operation state of the vacuum pump, wherein the setter predicts, on a basis of the number of times of occurrence of the abnormality in a case where an operation time of the vacuum pump reaches a first time, the number of times of occurrence of the abnormality in a case where the operation time of the vacuum pump reaches a second time longer than the first time as a predicted number of times of occurrence, and sets or changes the first threshold on the basis of the predicted number of times of occurrence.

2. The vacuum pump system according to claim 1, wherein the setter sets or changes the first threshold on the basis of a history of occurrence of the abnormality.

3. The vacuum pump system according to claim 1, wherein in a case where the predicted number of times of occurrence is less than the first threshold stored in the storage, the setter sets the predicted number of times of occurrence as a new first threshold.

4. The vacuum pump system according to claim 1, wherein in a case where the predicted number of times of occurrence is the first threshold, which is stored in the storage, or more, the setter determines that the first threshold stored in the storage is maintained.

5. The vacuum pump system according to claim 1, wherein the vacuum pump has a measurer configured to measure the operation state of the vacuum pump, and the setter determines, on a basis of whether or not a measurement value sensed by the measurer is a second threshold or more, whether or not there is a risk of damage of the vacuum pump, and sets or changes the first threshold on the basis of the predicted number of times of occurrence and whether or not there is the risk of damage of the vacuum pump.

6. The vacuum pump system according to claim 5, wherein the setter sets the predicted number of times of occurrence as a new first threshold in a case where it is determined that the measurement value is less than the second threshold, there is no risk of damage of the vacuum pump, and the predicted number of times of occurrence is greater than the first threshold stored in the storage.

7. The vacuum pump system according to claim 5, wherein the setter sets the predicted number of times of occurrence as a new first threshold in a case where it is determined that the measurement value is the second threshold or more, there is the risk of damage of the vacuum pump, and the predicted number of times of occurrence is less than the first threshold stored in the storage.

8. The vacuum pump system according to claim 1, wherein the abnormality is at least one selected from an abnormality regarding vibration of the vacuum pump and an abnormality regarding a load of the vacuum pump.

9. A method for controlling a vacuum pump configured to pump gas by drive of a rotor by a motor, comprising:

counting a number of times of occurrence of an abnormality occurred in the vacuum pump;

setting or changing a first threshold for the number of times of occurrence of the abnormality for outputting an alarm on a basis of an operation state of the vacuum pump; and outputting the alarm in a case where the number of times of occurrence of the abnormality is the first threshold or more, wherein the setting or changing includes predicting, on a basis of the number of times of occurrence of the abnormality in a case where an operation time of the vacuum pump reaches a first time, the number of times of occurrence of the abnormality in a case where the operation time of the vacuum pump reaches a second time longer than the first time as a predicted number of times of occurrence, and setting or changing the first threshold on the basis of the predicted number of times of occurrence.

* * * * *